US005687919A

United States Patent [19]

Cory

[11] Patent Number: 5,687,919

[45] Date of Patent: Nov. 18, 1997

[54] APPARATUS FOR PRODUCING SIMULATED SNOW EFFECTS

[76] Inventor: Philip C. Cory, 10474 Santa Monica Blvd., Suite 305, Los Angeles, Calif. 90025

[21] Appl. No.: 625,145

[22] Filed: Apr. 1, 1996

[51] Int. Cl.[6] ..... B02C 18/08

[52] U.S. Cl. ..... 241/60; 241/92; 241/101.77; 241/DIG. 17

[58] Field of Search ..... 62/321; 241/60, 241/92, DIG. 17, 101.77

[56] References Cited

U.S. PATENT DOCUMENTS

| | | | |
|---|---|---|---|
| 2,081,001 | 5/1937 | Coscia | 241/92 |
| 2,136,214 | 11/1938 | Keith | 241/DIG. 17 X |
| 2,310,552 | 2/1943 | Schaaf | 241/DIG. 17 X |
| 2,552,933 | 5/1951 | Browne | 241/92 |
| 4,411,573 | 10/1983 | Townsend | 241/101.77 X |
| 4,962,895 | 10/1990 | Gallaher | 241/DIG. 17 X |

*Primary Examiner*—Mark Rosenbaum
*Attorney, Agent, or Firm*—Michael A. Painter

[57] ABSTRACT

An apparatus for producing simulated snow effects for theatrical environments. To create simulated snow in the quantities and qualities necessary for theatrical effects, ice is used as the source material. A plurality of storage channels are adapted for holding and channeling blocks of ice to the snow creating member. A rotating disc incorporates a plurality of radially directed, adjustable cutting blades mounted in the surface of the disc. The disc is rotatable beneath each of the ice supply channels. Each of the cutting blades is pivotable along one radial edge thereof, the angular position of the blade relative to the surface of the disc determining the thickness of the layer of ice shaved from the surface of the ice block in contact therewith. Immediately forwardly of each ice cutting blade is an aperture disposed in the disc to provide a downwardly directed fluid force to the shaved ice. When elevated, shavings or flakes of ice having a selectable thickness from 0.005–0.030 inches may be distributable over an area in excess of 2,000 square feet.

4 Claims, 2 Drawing Sheets

FIG. 1.
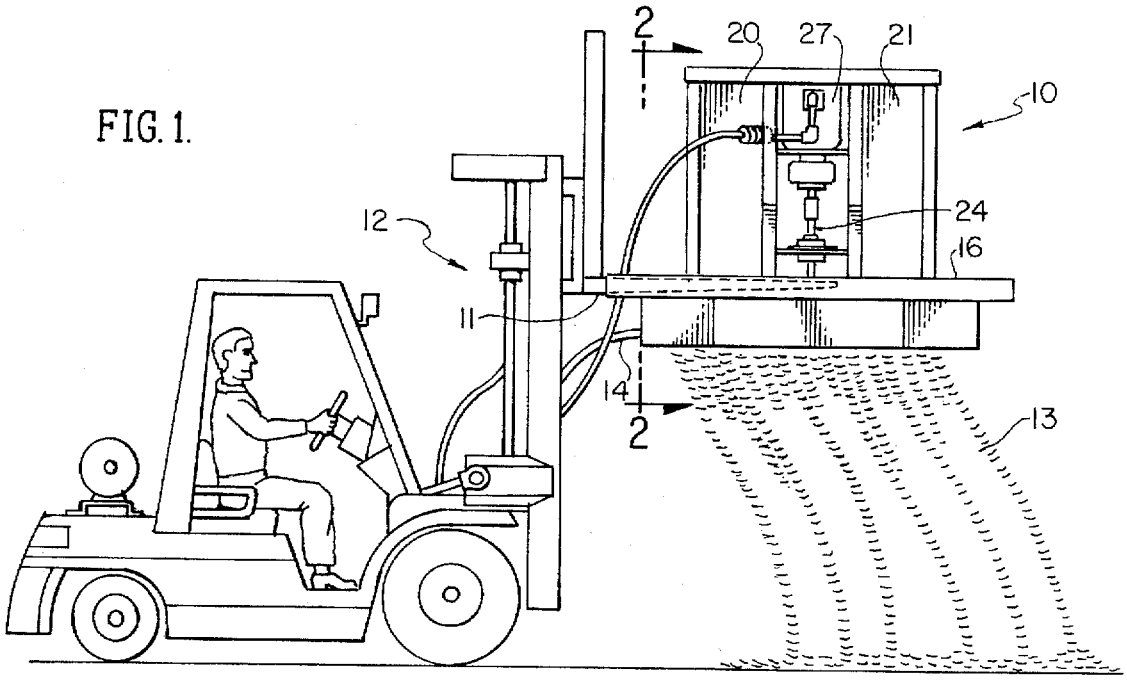
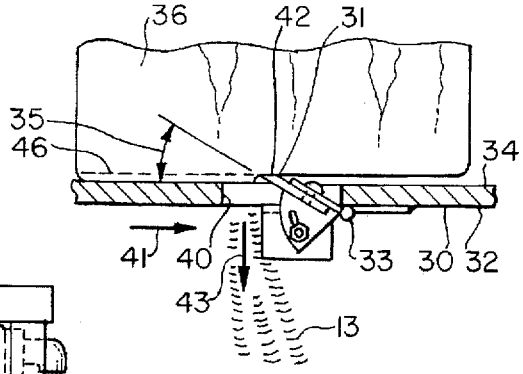
FIG. 5.
FIG. 2.
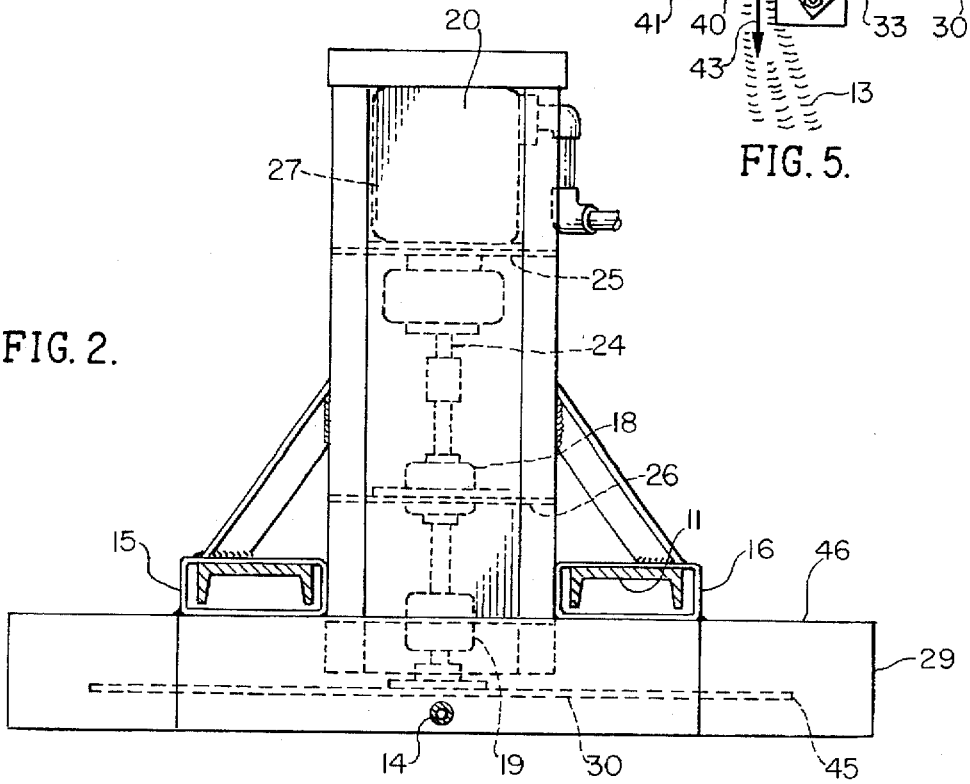

APPARATUS FOR PRODUCING SIMULATED SNOW EFFECTS

BACKGROUND OF THE INVENTION

1. Field of the Invention

The present invention generally relates to apparatus used to create theatrical effects and, more particularly, to those employed for creating simulated snow.

2. Prior Art

With the increasing need for realism in the production of theatrical properties, many devices are disclosed for producing simulated environmental effects, including the appearance of falling snow. Since the production of a motion picture or television film can incur great expense, it has become extremely important to provide a means to simulate selected environmental conditions at the time and at the place required.

To produce the illusion of falling snow, the prior art discloses numerous solutions, none of which are fully adequate. Where a technical scene requires falling snow, having to rely on natural conditions is unacceptable. The problems are obvious. Given the necessity to require the occurrence of a natural element at a specific place, at a specific time and with a desired intensity requires that the effect of falling snow, or any other event, to be artificially generated in order to avoid unnecessary expenses.

One of the methods taught by the prior art to create the effect of falling snow utilizes artificial snow flakes produced of synthetic materials such as plastic. Although possibly acceptable under static conditions, when a scene calls for the realistic appearance of falling snow, this method is inherently inadequate. To produce theatrical effects which are realistic, the user must be able to rely upon an adequate, available supply of simulated snow which is available where and when needed. The ability to produce artificial material which meets these criteria renders this method to be unacceptable.

The present invention resolves the problems inherent in the devices and methods disclosed by the prior art. To produce material which may simulate falling snow at the appropriate time and limited to a specific location is essential. One of the objects of the present invention is to provide an ample source of simulated snow at the location needed for a sufficient period of time necessary to complete the scene. For realism, the source material employed by the present invention is ice typically in block form.

A plurality of storage channels concurrently provide an immediate source of material for the present invention and channel the supply of solid ice to a plurality of cutting blades which will reduce the ice to a form which satisfies the theatrical objectives. The lower terminus of each of the storage channels is in communication with the upper surface of a rotatable disc. The disc incorporates a plurality of radially oriented cutting blades. Each cutting blade is pivotable relative to the surface of the disc, the relative angle between the cutting blade and the upper surface of the disc providing the means to select the thickness of the layer shaved from the ice source. An aperture is disposed through the disc forwardly of each blade. The frozen material shaved from the ice source will be urged through the aperture. The present invention is elevated above and adjacent to the area where the theatrical effect is to be utilized. A source of pressurized air laterally deflects the shaved, material thereby producing the effect of falling snow in precisely the location where needed.

SUMMARY OF THE INVENTION

A plurality of storage channels are adapted to provide sources of the raw material employed by the present invention. Typically, the source material for producing the theatrical effect of falling snow flakes is block ice. Each of the channels is disposed vertically and have an open lower terminus lying in a common plane. A rotatable shaft is mounted between the storage channels, the lower end thereof extending to the plane of the lower terminus of each of the storage channels. A disc is secured to the lower end of the rotatable shaft, the radius of the disc extending beyond the open terminus of each storage channels. A plurality of cutting blades are pivotally coupled to the upper surface of the disc and are radially oriented with respect to the rotatable shaft. Each cutting blade is pivotally coupled to the surface of the disc in order to permit the production of flakes having a predetermined thickness. An aperture is disposed through the surface of the disc and forwardly of each cutting blade. By utilizing a gravity feed, the ice source disposed in each storage channel is in communication with the rotating cutting blades. Ice flakes of a predetermined thickness are cut from the lower surface of the ice sources, the orientation of the rotating cutting blades producing a fluid force directing the shaved ice or flakes to flow through the apertures in the rotating disc. Elevation members are provided to assist the elevation of the present invention to a predetermined height above the theatrical scene for which the effect is being produced. The falling ice flakes are dispensed by a horizontally directed source of pressurized air to produce the effect of falling snow over a selected area.

It is therefore an object of the present invention to provide an improved apparatus for producing simulated falling snow.

It is another object of the present invention to provide a theatrical effect in the form of falling snow over a predetermined area.

It is still another object of the present invention to provide an apparatus for producing simulated snow of selectable thickness.

It is still yet another object of the present invention to provide an apparatus for producing simulated snow effects which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a perspective view illustrating the use of the present invention to produce simulated snow for a theatrical stage effect.

FIG. 2 is a left side elevation view of the present invention shown in FIG. 1 taken through line 2—2 of FIG. 1;

FIG. 5 is an enlarged cross-sectional view of a cutting blade as shown in FIG. 4 taken through line 5—5 of FIG. 4.

DESCRIPTION OF THE PRESENTLY PREFERRED EMBODIMENT

Figure 3:
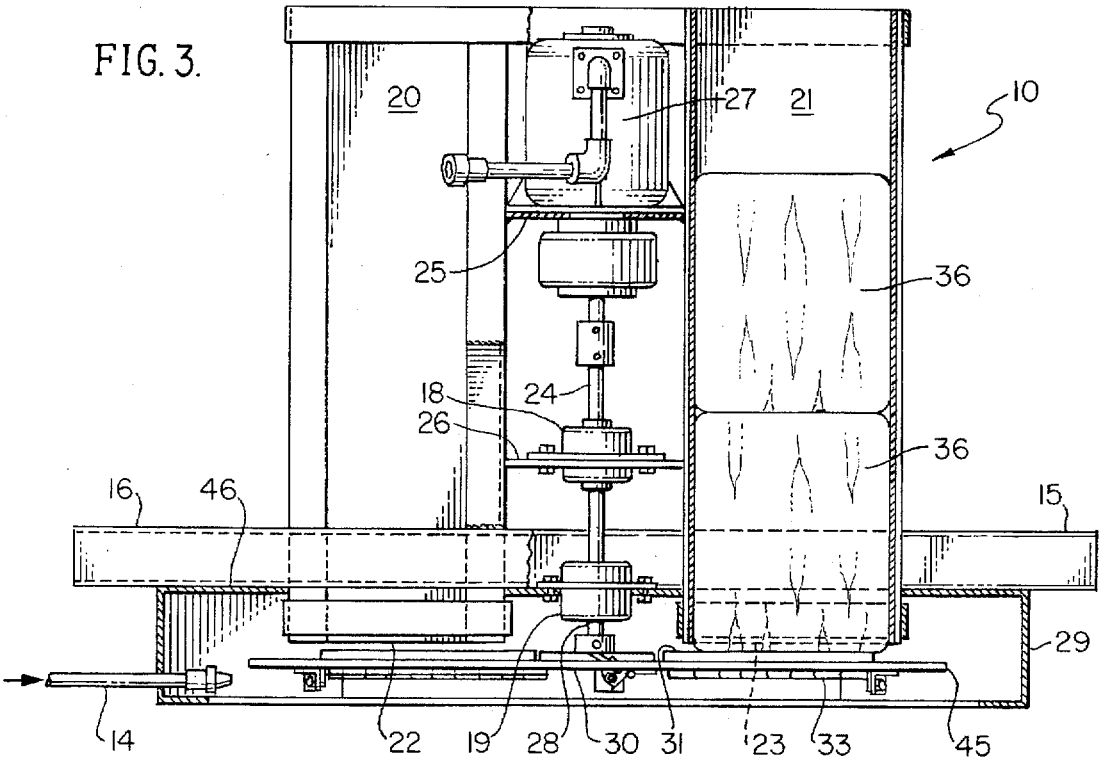
FIG. 3 is a partial, cross-sectional view of the present invention apparatus for producing simulated snow effects as shown in FIG. 1.

The use of the present invention may be best understood by reference to FIG. 1 wherein the creation of a simulated snow effect by the present invention apparatus is shown being dispersed over a selected area, the present invention being generally designated by the reference numeral 10. It is an objective of the present invention to provide an apparatus which will permit the production of simulated snow to be used as special effects in theatrical settings. As can be seen in FIG. 1, the present invention apparatus 10 is elevated to a predetermined height by conventional means such as the operating arms 11 of fork lift 12. The output of the present invention comprises a stream 13 of shaved ice which are emitted from the lower terminus of the present invention apparatus, the stream of ice flakes 13 being horizontally distributed over a given area as a result of the operation of a source 14 of pressurized air.

Referring now to FIG. 2 and FIG. 3, a pair of supply channels 20 and 21 provide in-use supply sources for blocks of solid ice 36 (FIG. 5) which will be used as the source of the ice flake stream 13. Supply channels 20 and 21 define a vertical shaft having lower openings 22 and 23, respectively, to lie in a common plane. A rotatable drive shaft 24 is disposed intermediate supply channels 20 and 21 and is rotatably coupled through bracing flanges 25 and 26 and is journeled therethrough by suitable bearings 18 and 19. The upper end of drive shaft 24 is axially secured to the rotating output shaft of a conventional motor 27. The lower end 28 of drive shaft 24 being axially secured to disc 30.

The lower openings 22 and 23 of supply channels 20 and 21 are in communication with the interior of housing 29 which is disposed about and shields the outer edge 45 of disc 30. As stated hereinabove, in order to meet an objective of the present invention, the present invention apparatus 10 is elevated to a height which will permit the stream 13 of ice flakes to be dispersed upon a predetermined area. A pair of receiving members 15 and 16 are secured to the upper surface 46 of housing 29 on opposed sides of supply channels 20 and 21. As shown in FIG. 1, operating arms 11 of a conventional fork lift 12 are adapted to be received within receiving members 15 and 16 for the purpose of elevating the structure of the present invention apparatus 10.

Figure 4:
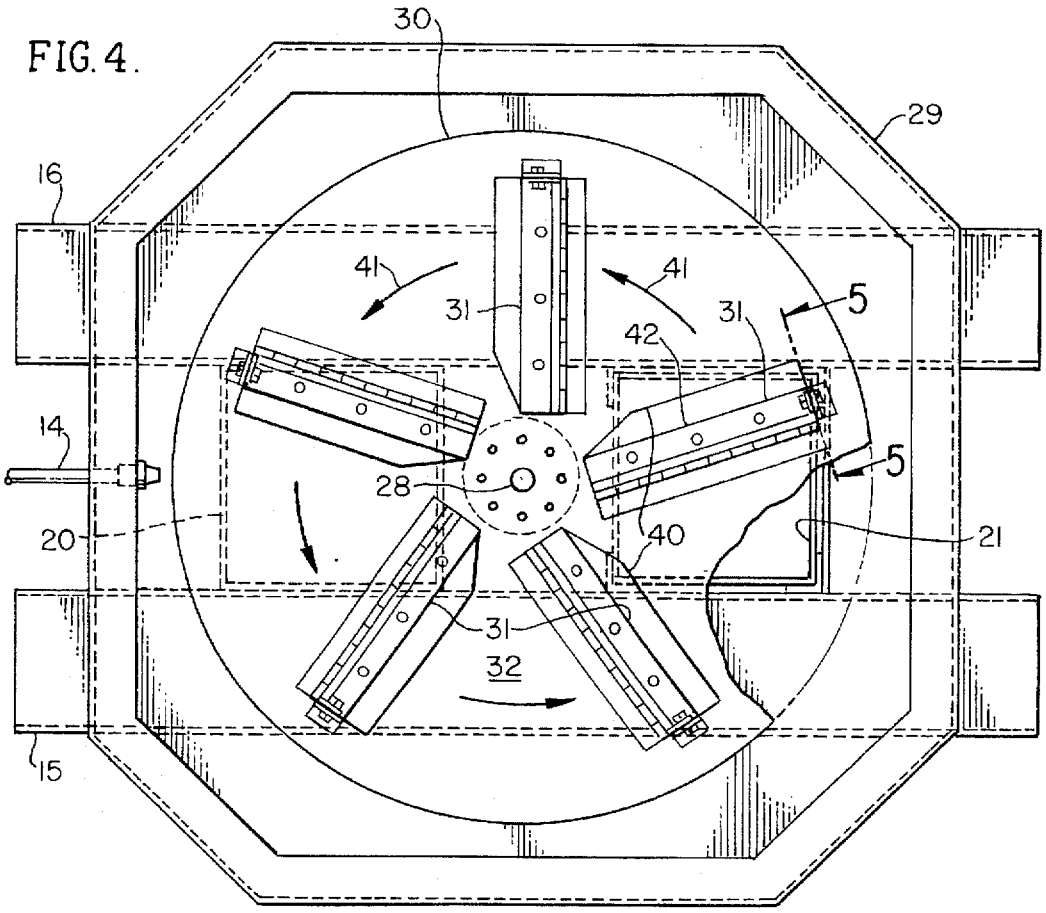
FIG. 4 is a bottom plan view of the present invention shown in FIG. 3 illustrating the disc incorporating cutting blades for producing simulated snow flakes in accordance with the present invention.

The construction of disc 30 may be best understood by reference to FIGS. 3 and 4. Disc 30 is axially aligned with and secured to the lower end 28 of drive shaft 24 and is rotatable therewith. Disc 30 incorporates a plurality of cutting blades 31. Each cutting blade is pivotally coupled to the lower surface 32 of disc 30 by a plurality of suitable locking hinge 33 which will permit the relative angle 35 between a cutting blade 31 and the upper surface 34 of disc 30 to be set at a selected magnitude which will determine the thickness of the flakes shaved from ice blocks 36 (FIG. 5). Each of the cutting blades 31 pivot upwardly within a substantially radial aperture 40 disposed through disc 30. In the preferred embodiment of the present invention, the thickness 46 of the shaved ice or flakes or must be in a range of 0.005–0.030 inches, the thickness being dependent upon the theatrical effect which the user desires. The smaller the relative angle 35 between cutting blade 31 and upper surface 34, the thinner will be the thickness 46 of the flake shaved from ice blades 31.

As shown in FIGS. 4 and 5, disc 30 will rotate in a direction generally designated by the reference numeral 41. By providing an aperture 40 forwardly from the cutting edge 42 of cutting blade 31, a downwardly directed fluid force will be created by the rotating cutting blades 31, the force being substantially in the direction designated by the reference numeral 43. As stated hereinabove, it is an objective of the present invention to provide an apparatus to create the illusion of falling snow which is limited to a specific area. As ice 36 is shaved by the rotation of cutting blades 31, a stream of ice flakes 13 will be forced through aperture 40. As can be seen in FIG. 3, a horizontal source of pressurized air 14 is mounted through housing 29 which will angularly deflect the stream 13 of ice flakes. The deflection of the stream 13 of the ice flakes will create the effect of falling snow by concurrently creating the desired density by limiting the thickness of the ice flakes and direct the stream 13 to the area where the theatrical effect is needed.

I claim:

1. An apparatus for producing simulated snow effects for theatrical purposes comprising:

(a) a first and second adjacent vertical supply channels having open upper and lower ends, the lower end of each of said first and second supply channels being in a planar relationship with each other;

(b) a rotary power source disposed between and in parallel relation to said first and second supply channels;

(c) a drive shaft having first and second ends, the first end being coupled to said rotary power source, the second end extending beyond the plane of the lower ends of said first and second supply channels;

(d) a disc having upper and lower surfaces axially secured to the second end of said drive shaft and having a plurality of apertures disposed therethrough from the upper surface to the lower surface thereof;

(e) a plurality of planar cutting blades, each being pivotally coupled to the lower surface of said disc and extending upwardly through a respective aperture in said disc (f) a housing disposed about and secured to said first and second supply channels and having an outer wall extending downwardly about and beyond the lower surface of said disc; and (g) a pressurized air conduit being coupled through the outer wall of said housing adjacent the lower surface of said disc, said pressureized air conduit being aligned with the drive shaft.

2. An apparatus for producing simulated snow effects as defined in claim 1 further including means secured to said supply channels for elevating said apparatus.

3. An apparatus for producing simulated snow effects from block ice for theatrical purposes comprising:

(a) first and second vertical supply channels adapted to receive the block ice having open upper and lower ends, the lower end of each of said supply channels being in a in parallel spaced relationship with each other;

(b) a rotary motor having an axial rotatable shaft secured between and in parallel spaced relationship to said supply channels;

(c) a drive shaft having first and second ends, the first end being axially coupled to the rotatable shaft of said rotary motor, the second end extending beyond the plane of the lower ends of said supply channels;

(d) a cylindrical disc having upper and lower surfaces axially secured to the second end of said drive shaft and having at least four radially oriented apertures disposed therethrough from the upper surface to the lower surface thereof;

(e) a plurality of planar cutting blades, each being pivotally coupled to the lower surface of said cylindrical disc and extending upwardly through a respective aperture in said cylindrical disc, the angle between each of said cutting blades and the upper surface of said disc being adapted to engage the block ice within said first and second supply channels whereby the angle between each of said cutting blades and the upper surface of said disc is adapted to determine the density of the simulated snow;

(p) a housing having an upper surface perpendicular to said drive shaft coupled about said first and second supply channels and extending downwardly into an outer wall encompassing said disc, said outer wall extending vertically below the lower surface of said disc; and (g) a pressurized air conduit being disposed through the outer wall of said housing adjacent the lower surface of said disc and being aligned with the drive shaft whereby the simulated snow will be spacially urged in a direction responsive to the orientation of the pressurized air conduit.

4. An apparatus for producing simulated snow effects as defined in claim 3 further including means secured to said supply channels for elevating said apparatus.

* * * * *